US007140919B2

(12) United States Patent
Yu

(10) Patent No.: US 7,140,919 B2
(45) Date of Patent: Nov. 28, 2006

(54) STRUCTURE OF USB CONNECTOR WITH POWER AND SIGNAL FILTER MODULES

(75) Inventor: Chih-Ching Yu, Taipei Hsien (TW)

(73) Assignee: Speed Tech Corp. (TW)

( * ) Notice: Subject to any disclaimer, the term of this patent is extended or adjusted under 35 U.S.C. 154(b) by 280 days.

(21) Appl. No.: 10/885,765

(22) Filed: Jul. 8, 2004

(65) Prior Publication Data

US 2006/0009076 A1 Jan. 12, 2006

(51) Int. Cl.
*H01R 13/66* (2006.01)

(52) U.S. Cl. ..... 439/620.13; 439/620.22; 439/541.5

(58) Field of Classification Search ..... 439/620, 439/541.5, 620.07, 620.09, 620.13–18, 620.21, 439/620.22, 941
See application file for complete search history.

(56) References Cited

U.S. PATENT DOCUMENTS 6,394,846 B1 * 5/2002 Belopolsky et al. ..... 439/620
6,688,914 B1 * 2/2004 Espenshade et al. ..... 439/541.5
6,776,651 B1 * 8/2004 Liu ..... 439/490
6,835,098 B1 * 12/2004 Chang ..... 439/620

* cited by examiner

*Primary Examiner*—Hae Moon Hyeon
(74) *Attorney, Agent, or Firm*—Bacon & Thomas PLLC

(57) ABSTRACT

A structure of a USB connector comprising an isolation chassis and an electric module is provided. The circuit board has a plurality of interconnection-terminals and a plurality of adaptor-terminals, wherein the power wave-filter module is positioned in a positive and negative power line of the circuit board and electrically connects to a first terminal and a fourth terminal of the interconnection-terminals and the signal wave-filter module is positioned in a signal line of the circuit board and electrically connects to a second terminal and a third terminal of the interconnection-terminals so as to cancel noise generated during signal transmission.

4 Claims, 4 Drawing Sheets

STRUCTURE OF USB CONNECTOR WITH POWER AND SIGNAL FILTER MODULES

BACKGROUND OF THE INVENTION

1. The Field of the Invention

The present invention relates to a structure of connector, and more particularly, to an USB, Universal Serial Bus, connector having a built-in electrical module capable of reducing electro-magnetic interference generated during signal and power transmission so as to meet high speed signal transmission requirement.

2. Description of Related Art

With the recent rapid development of computer technology, high-tech products are highly developed and becoming highly popular nowadays. For transmitting information or using peripheral devices, interfaces are essential. The universal serial bus, namely USB, is a new generation of the interface for the computer peripheral devices, with several transmission speeds, such as 1.5 Mbps, 12 Mbps and 480 Mbps. Because the transmission speed of the USB is much faster than the parallel ports and the serial ports of the personal computer, therefore, applications of the USB in the computer devices can substantially enhance the transmission speed. Furthermore, the operation systems, such as Windows 98 or other advanced versions, support the USB interface, almost all the peripheral communication ports of the personal computer have the unified specification to support the USB interface, for example, the network card, the hub, the keyboard, the mouse, the joystick, the CD ROM, the driver, the printer, the scanner, the digital camera and so on. Obviously, the USB is an essential resource for all the users. Therefore, the computer must have the connector complying with the USB adaptor. On the other hand, the electro-magnetic wave will be generated during electronic signals and powers transmitting in electronic components and such electro-magnetic wave will interfere each other. The high-speed transmitting power and the signals in the USB connector will be easily infected by electro-magnetic interference, and the electro-magnetic interference will result signal errors or power voltage unstable during the transmission. Accordingly, the wave-filter is required on the circuit board to coordinate with the connector in order to reduce the electromagnetic interference. However, such prior design needs the filter to be built on the circuit board, there are more and more difficulties to offer such space for the filter in the trend of minimizing the dimensions of electrical devices.

Therefore, above defects of the conventional art are important issues for the manufacturers in the field to improve.

SUMMARY OF THE INVENTION

Accordingly, in the view of the foregoing, the present invention provides an innovative cost effective connector capable of meeting high-speed signal transmission requirement.

It is an object of the present invention, a built-in electric module disposed in an isolation chassis of the connector comprises a signal wave-filter module and a power wave-filter module. The signal wave-filter module and the power wave-filter module are adapted for filtering out the electro-magnetic wave during the signal and power transmission. Thus, the connector of the present invention is capable of meeting high-speed signal transmission requirement and saving space occupation on the circuit board.

It is another object of the present invention, the signal wave-filter module and the power wave-filter module are installed on the circuit board of the electric module to effectively reduce the space occupation on the circuit board.

BRIEF DESCRIPTION OF THE DRAWINGS

For a more complete understanding of the present invention, reference will now be made to the following detailed description of preferred embodiments taken in conjunction with the following accompanying drawings.

DETAILED DESCRIPTION OF PREFERRED EMBODIMENTS

Figure 1:
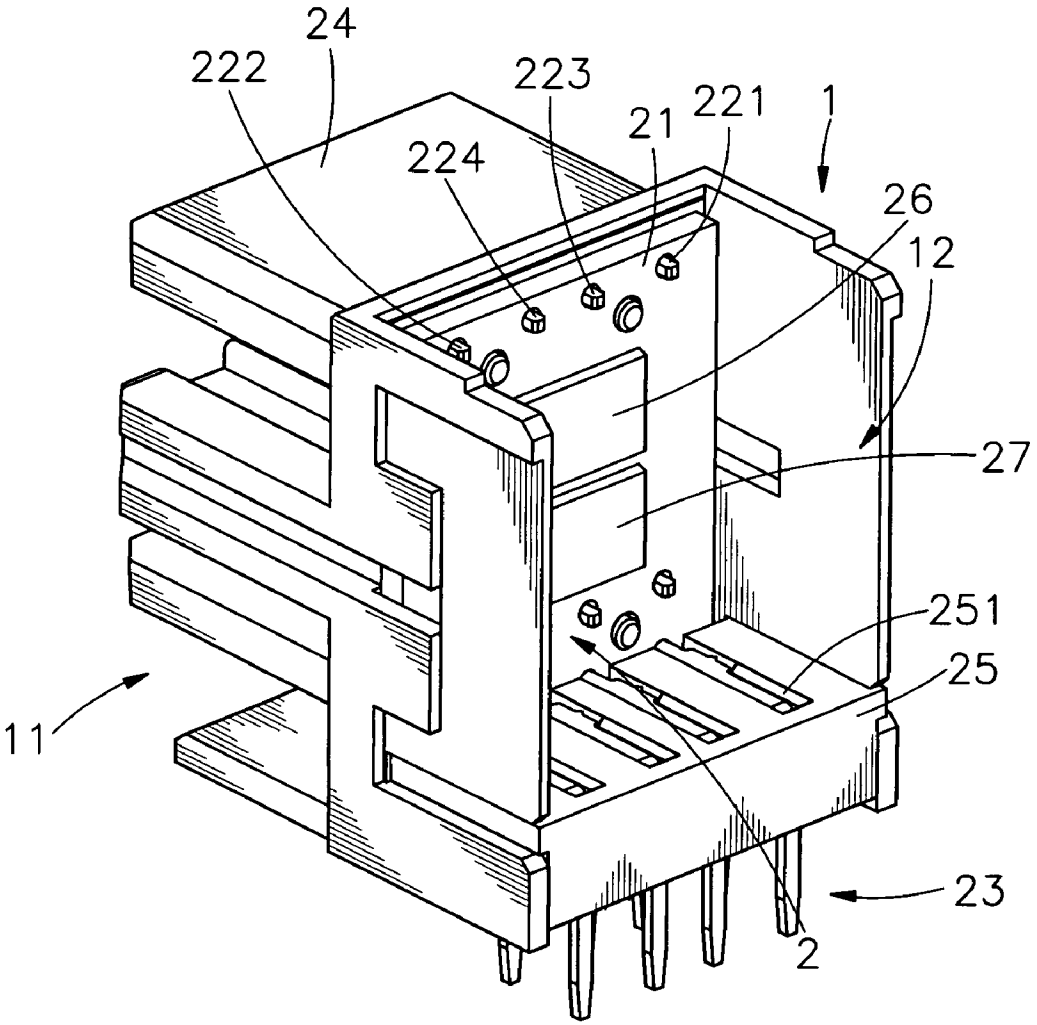
FIG. 1 is an elevational view of a connector according to an embodiment of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
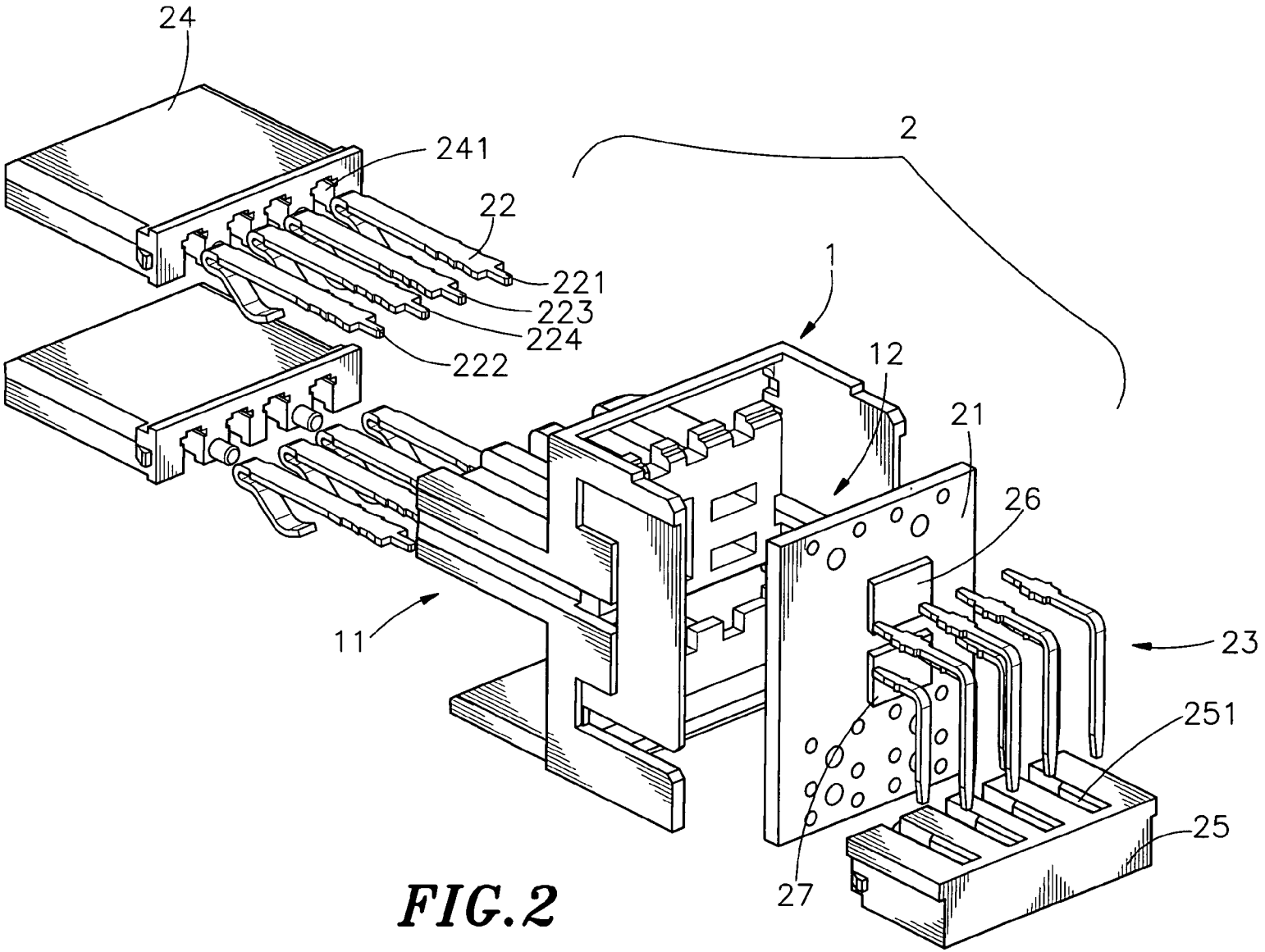
FIG. 2 is an exploded view of a connector according to an embodiment of the present invention.
Figure 3:
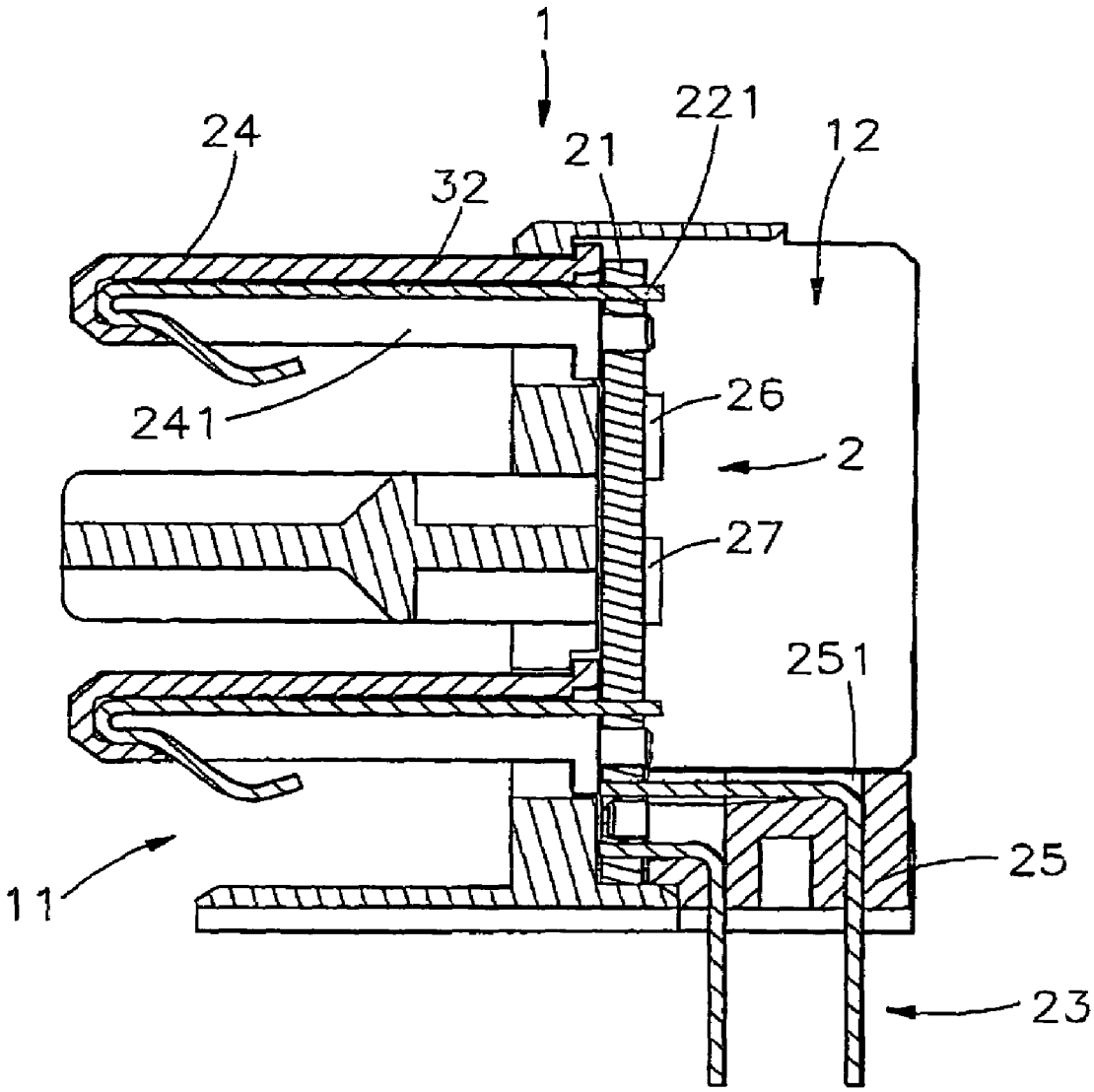
FIG. 3 is a sectional side view of a connector according to an embodiment of the present invention.

Referring to FIGS. 1, 2 and 3, the connector, according to an embodiment of the present invention, comprises an isolation chassis 1 and an electric module 2.

The isolation chassis 1 comprises a mating portion 11 on one side and a receiving space 12 on the other side thereof.

The electric module 2 comprises a plurality of interconnection-terminals 22 and a plurality of adaptor-terminals 23 extending from a built-in circuit board 21 outwardly. The interconnection-terminals 22 can be inlayed into slots 241 of an interconnection terminal set 24 and the adaptor-terminals 23 can be inlayed into slots 251 of an adaptor terminal set 25. Furthermore, please refer to FIG. 4, the built-in circuit board 21 comprises positive and negative power lines 211 and signal lines 212. The positive and the negative power lines 211 are connected to a power wave-filter module 26 and the signal lines 212 are connected to a signal wave-filter module 27. The interconnection-terminals 22 comprise a first terminal 221 and a fourth terminal 222 that can be connected to the positive and the negative power lines 211 on the built-in circuit board 21 and electrically connected to the power wave-filter module 26. The interconnection-terminals 22 comprise a second terminal 223 and a third terminal 224 that can be connected to the signal lines 212 on the built-in circuit board 21 and electrically connected to the signal wave-filter module 27.

To assemble the parts, the built-in circuit board 21 of the electric module 2 is inlayed into the receiving space 12 of the isolation chassis 1 and the interconnection-terminals 22 connected to the power wave-filter module 26 and the signal wave-filter module 27 on the built-in circuit board 21 are penetrated to the interconnection terminal set 24 inlayed into the mating portion 11 of the isolation chassis 1. The adaptor-terminals 23 are installed to the built-in circuit board 21 and inlayed into slots 251 of the adaptor terminal set 25 disposed in the receiving space 12 of the isolation chassis 1.

Figure 4:
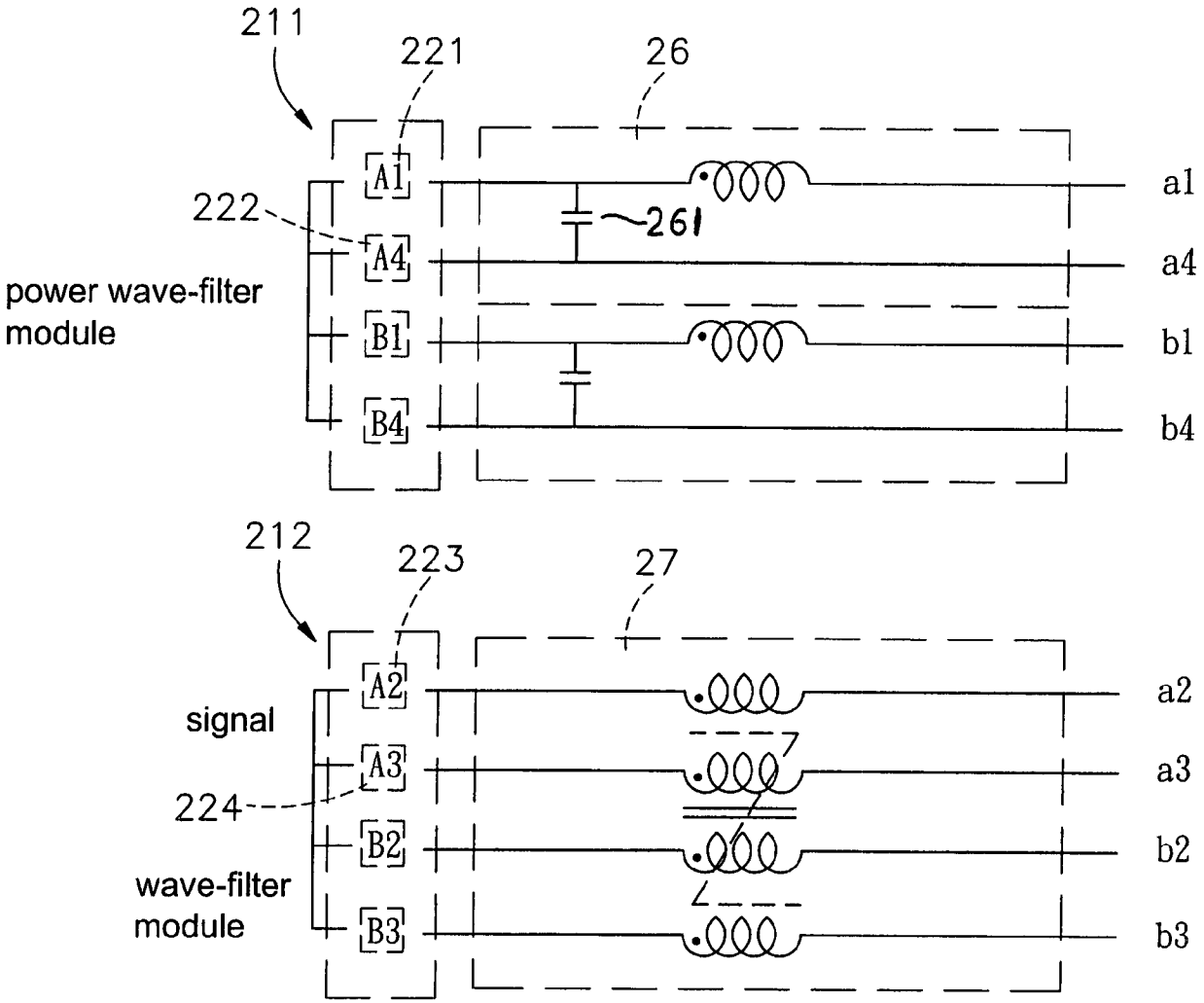
FIG. 4 is a circuit diagram of a connector according to an embodiment of the present invention.

Referring to FIGS. 2, 3 and 4, the complementary USB connector, plug, electrically connected to the interconnection-terminals 22 disposed at the mating portion 11 of the isolation chassis 1 for establishing electrical communication between two electronic devices. During the electrical communication, the signals and power transmitted between said two electronic devices will pass through the built-in circuit board 21 comprising the power wave-filter module 26 and the signal wave-filter module 27, and the interference caused by electro-magnetic wave generated by other electronic components will be filtered. Thus, the USB connector will be to perform in high-speed transmission.

In addition, the positive and the negative power lines 211 of the built-in circuit board 21 can further comprise a capacitor 261 for some special high frequency circumstances.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. A structure of a Universal Serial Bus (USB) connector, comprising:

an isolation chassis, comprising a mating portion and a receiving space opposite each other; and an electric module, comprising a built-in circuit board disposed in the receiving space of said isolation chassis, a plurality of interconnection-terminals penetrating from said built-in circuit board to the mating portion of said isolation chassis and a plurality of adaptor-terminals extending from said built-in circuit board outwardly, wherein said built-in circuit board has a power wave-filter module with positive and negative power lines electrically connecting with two particular interconnection-terminals, a signal wave-filter module electrically connecting with other interconnection-terminals.

2. The structure of USB connector according to claim 1, wherein said interconnection-terminals are disposed on said built-in circuit board and inlayed into an interconnection terminal set disposed in the mating portion of said isolation chassis.

3. The structure of USB connector according to claim 1, wherein said adaptor-terminals are disposed on said built-in circuit board and inlayed into slots of an adaptor terminal set disposed in the receiving space of said isolation chassis.

4. The structure of USB connector according to claim 1, wherein said built-in circuit board has a capacitor.

* * * * *